US011382412B2

(12) United States Patent
Park et al.

(10) Patent No.: US 11,382,412 B2
(45) Date of Patent: Jul. 12, 2022

(54) METHOD AND APPARATUS FOR CLEANING PVA BRUSH

(71) Applicants: EBARA CORPORATION, Tokyo (JP); Industry-University Cooperation Foundation Hanyang University Erica Campus, Gyeonggi-do (KR)

(72) Inventors: Jin-Goo Park, Gyeonggi (KR); Jung Hwan Lee, Gyeonggi-do (KR); Satomi Hamada, Tokyo (JP)

(73) Assignees: EBARA CORPORATION, Tokyo (JP); INDUSTRY-UNIVERSITY COOPERATION FOUNDATION HANYANG, Gyeonggi-Do (KR)

( * ) Notice: Subject to any disclaimer, the term of this patent is extended or adjusted under 35 U.S.C. 154(b) by 28 days.

(21) Appl. No.: 16/648,994

(22) PCT Filed: Sep. 20, 2018

(86) PCT No.: PCT/KR2018/011169
§ 371 (c)(1),
(2) Date: Mar. 19, 2020

(87) PCT Pub. No.: WO2019/059683
PCT Pub. Date: Mar. 28, 2019

(65) Prior Publication Data

US 2020/0281347 A1 Sep. 10, 2020

(30) Foreign Application Priority Data

Sep. 21, 2017 (KR) ..... 10-2017-0121997

(51) Int. Cl.
*B08B 3/08* (2006.01)
*A46B 17/06* (2006.01)
(Continued)

(52) U.S. Cl.
CPC ..... *A46B 17/06* (2013.01); *A46D 1/045* (2013.01); *A46D 9/04* (2013.01); *B08B 3/08* (2013.01); *B08B 3/12* (2013.01)

(58) Field of Classification Search
None
See application file for complete search history.

(56) References Cited

U.S. PATENT DOCUMENTS 10,170,343 B1 * 1/2019 Wei ..... H01L 21/02096
2002/0055323 A1 * 5/2002 McClain ..... B24B 57/02 451/41
(Continued)

FOREIGN PATENT DOCUMENTS

JP 10-223583 A 8/1998
JP 11-323000 A 11/1999
(Continued)

OTHER PUBLICATIONS

International Search Report dated Jan. 17, 2019 for WO 2019/059683 A1.

*Primary Examiner* — Mikhail Kornakov
*Assistant Examiner* — Ryan L Coleman
(74) *Attorney, Agent, or Firm* — Venjuris, P.C.

(57) ABSTRACT

A PVA brush cleaning method includes immersing a PVA brush in a cleaning solution containing an organic matter, thereby removing a siloxane compound in the PVA brush; and applying vibration to the PVA brush, thereby removing impurities in the PVA brush.

11 Claims, 10 Drawing Sheets

(51) Int. Cl.

| | |
|---|---|
| ***A46D 1/045*** | (2006.01) |
| ***A46D 9/04*** | (2006.01) |
| ***B08B 3/12*** | (2006.01) |

(56) References Cited

U.S. PATENT DOCUMENTS

| | | | | |
|---|---|---|---|---|
| 2006/0030503 | A1* | 2/2006 | Minamihaba | H01L 21/31058 510/175 |
| 2008/0202555 | A1* | 8/2008 | Shibazaki | G03F 7/70716 134/6 |
| 2016/0254170 | A1* | 9/2016 | Hu | B08B 3/102 134/1.3 |
| 2017/0306273 | A1* | 10/2017 | Ueno | H01L 21/6835 |
| 2018/0337102 | A1* | 11/2018 | Withers | H01L 22/26 |
| 2019/0346764 | A1* | 11/2019 | Kamimura | G03F 7/325 |

FOREIGN PATENT DOCUMENTS

| | | | |
|---|---|---|---|
| JP | 2010-021457 | A | 1/2010 |
| KR | 10-2005-0058832 | A | 6/2005 |
| KR | 10-2006-0103841 | A | 10/2006 |
| KR | 10-2008-0073586 | A | 8/2008 |

* cited by examiner

METHOD AND APPARATUS FOR CLEANING PVA BRUSH

CROSS REFERENCE TO RELATED APPLICATIONS

This application is a national phase of PCT application No. PCT/KR2018/011169, filed on 20 Sep. 2018, which claims priority from Korean Patent Application No. 10-2017-0121997, filed on 21 Sep. 2017, all of which are incorporated herein by reference.

TECHNICAL FIELD

The present disclosure relates to a PVA brush cleaning method and a PVA brush cleaning apparatus, and more particularly, to a PVA brush cleaning method and a PVA brush cleaning apparatus for removing impurities in a PVA brush in a state before being used.

BACKGROUND

After chemical mechanical planarization (CMP), a post-CMP cleaning process is required for removing particles or an organic residue of a substrate, and a cylindrical polyvinyl acetal (PVA) brush is generally used for this purpose. In a conventional PVA brush, a columnar nodule structure protrudes from the cylindrical PVA brush surface so as to increase a removal efficiency of residue, and the nodule structure comes into contact with substrate by a rotational movement and removes the residue on the substrate. In order to increase the cleaning efficiency, a cleaning solution may be used in a dispensing manner.

The PVA is molded and manufactured by mixing a pore-forming agent for forming pores in a resin mixture for cross-linking PVA and then by an injection molding the resin mixture so as to form the nodular structure on the surface thereof. After the injection molding, the pores are formed in the PVA brush by removing the pore-forming agent inside the PVA brush using, for example, a solution.

The PVA brush has a problem in that since the particles and organic impurities generated in the manufacturing process are present inside the brush, these internal impurities are transferred to the substrate during the cleaning process, thereby deteriorating production yield (yield). Thus, a pre-processing process (break-in process) is required to remove the impurities inside the brush before use. The pore-forming agent for forming pores may be incompletely removed after the manufacturing process becoming the impurities inside the PVA brush, or, for example, PVA debris having a low bonding strength due to incomplete cross-linking or a mixture such as, for example, a mold release agent for allowing a PVA brush product to be released from a mold after injection molding may be present as impurities in the PVA brush.

As a pre-processing process for a PVA brush, a deionized water (DIW) flow-through method in which, after the PVA brush is mounted in CMP equipment, DIW is pushed out through the pores in the PVA brush via a core located inside the PVA brush or a scrubbing method in which an unused substrate is scrubbed with the PVA brush is used. However, the DIW flow-through method has a problem in that the efficiency of removing impurities inside the PVA brush is poor, and the scrubbing method has a problem in that the internal impurity removal efficiency is also poor and in that it takes 15 hours or more, thereby deteriorating the productivity (throughput) of the CMP equipment. The conventional PVA brush pre-processing process shows a poor internal impurity removal efficiency. Thus, the process has an inherent problem that impurities are transferred to the substrate during a post-CMP cleaning process and the yield is deteriorated. In addition, since only the DIW is used, impurities that are insoluble in the DIW may not be removed. Accordingly, there is a need for developing a technique for a pre-processing process capable of removing the internal impurities with high efficiency.

In addition, the PVA brush pre-processing process using the conventional DEW flow-through method has a problem in that the analysis of residues is difficult because the concentration of the residues of a PVA brush contained in the DIW is low. Accordingly, there is a need for developing a technique fir collecting and analyzing the residues of a PVA brush at a high concentration.

Accordingly, various studies are being conducted on methods and apparatuses for removing the impurities inside a PVA brush. For example, Korea Patent Laid-Open Publication No. 10-2008-0073586 (Korean Patent Application No. 10-2007-0012361, Applicant: Hynix Semiconductor Co., Ltd.) discloses a PVA brush cleaning method including steps of: providing a polysilicon wafer; spraying an acidic chemical solution on the surface of the polysilicon wafer; and brining a contaminated PVA brush into contact with the surface of the polysilicon wafer sprayed with the acidic chemical solution. In addition, various techniques related to the laser crystallization method are being developed.

SUMMARY OF THE INVENTION

Problem to be Solved

A technical problem to be solved by the present disclosure is to provide a PVA brush cleaning method and a PVA brush cleaning apparatus that easily remove impurities in the form of particles.

Another technical problem to be solved by the present disclosure is to provide a PVA brush cleaning method and a PVA brush cleaning apparatus that easily remove impurities including organic matter.

Still another technical problem to be solved by the present disclosure is to provide a PVA brush cleaning method and a PVA brush cleaning apparatus improved in cleaning efficiency.

The technical problems to be solved by the present disclosure are not limited those described above.

Means to Solve the Problem

In order to solve the technical problems described above, the present disclosure provides a PVA brush cleaning method.

According to an embodiment, the PVA brush cleaning method may include steps of providing a PVA brush; removing a siloxane compound in the PVA brush using a cleaning solution containing organic matter; and removing impurities in the PVA brush by applying vibration to the PVA brush.

According to an embodiment, the cleaning solution may include the organic matter at a concentration of 10 wt % or more and less than 50 wt %.

According to an embodiment, in the step of removing the impurities in the PVA brush by applying vibration to the PVA brush, when the vibration is applied to the PVA brush for 10 minutes, an amount of the impurities removed from the PVA brush may have a maximum value.

According to an embodiment, the siloxane compound and the impurities in the PVA brush may be simultaneously removed.

According to an embodiment, the siloxane compound and the impurities in the PVA brush may be removed in such a manner that the impurities are removed after the siloxane compound is removed or the siloxane component is removed after the impurities are removed.

According to an embodiment, the organic matter may be THF or TMAH.

According to an embodiment, the siloxane compound may be PDMS.

According to an embodiment, the step of removing the siloxane compound in the PVA brush and the step of applying vibration to the PVA brush may be defined as a unit process, the PVA brush cleaning method may further include a step of measuring a frictional property and an elastic property of the PVA brush from which the siloxane compound and the impurities have been removed, and the unit process may be repeatedly performed when the measured frictional property and elastic property of the PVA brush are below a reference range.

According to an embodiment, the step of removing the impurities in the PVA brush by applying vibration to the PVA brush may include a process of measuring an amount of particulate impurities in the PVA brush to which the vibration is applied, using a particle measurement device.

According to an embodiment, the particle measurement device may include at least one of a single particle optical sizing (SPOS) method, a laser diffraction method, a dynamic light scattering method, and an acoustic attenuation spectroscopy method.

According to an embodiment, the step of removing the impurities in the PVA brush by applying vibration to the PVA brush may include a process of measuring an amount of organic impurities in the PVA brush to which the vibration is applied, using an organic matter measurement device.

According to an embodiment, the organic matter measurement device may include at least one of an ultraviolet detector, a conductivity detector, a current charge detector, a nondispersive infrared (NDIR) detector, and a total organic carbon analyzer.

According to an embodiment, the cleaning solution includes the organic matter having a RED range of less than 1 with respect to the PVA brush.

In order to solve the technical problems described above, the present disclosure provides a INA brush cleaning apparatus.

According to an embodiment, the PVA brush cleaning apparatus may include: a cleaning container in which a cleaning solution containing organic matter for removing a siloxane compound in a PVA brush is disposed, a vibration device configured to provide vibration for removing impurities in the PVA brush to the PVA brush and disposed in the cleaning container; a frictional property measurement device configured to measure a frictional property of the PVA brush from which the siloxane compound and the impurities have been removed; and an elasticity measurement device configured to measure an elastic property of the PVA brush from which the siloxane compound and the impurities have been removed.

According to an embodiment, the organic matter may be THF or TMAH, and the cleaning solution may include the organic matter at a concentration of 10 wt % or more and less than 50 wt %.

According to an embodiment, in PVA brush cleaning apparatus, when the vibration device applies the vibration to the PVA brush for 10 minutes, the amount of impurities removed from the PVA brush may have a maximum value.

According to an embodiment, the siloxane compound may be PDMS.

Effect of the Invention

According to an embodiment, the PVA brush cleaning method may include steps of: providing a PVA brush, removing a siloxane compound in the PVA, brush using a cleaning solution containing organic matter; and removing impurities in the PVA brush by applying vibration to the PVA brush. Accordingly, the organic matter and impurities in the form of particles in the PVA brush are easily removed. As a result, it is possible to provide a PVA brush cleaning method, which is capable of improving the yield of products obtained in, for example, a chemical mechanical planarization process, a semiconductor process, and a display process.

DESCRIPTION OF REFERENCE SYMBOL

Figure 1:
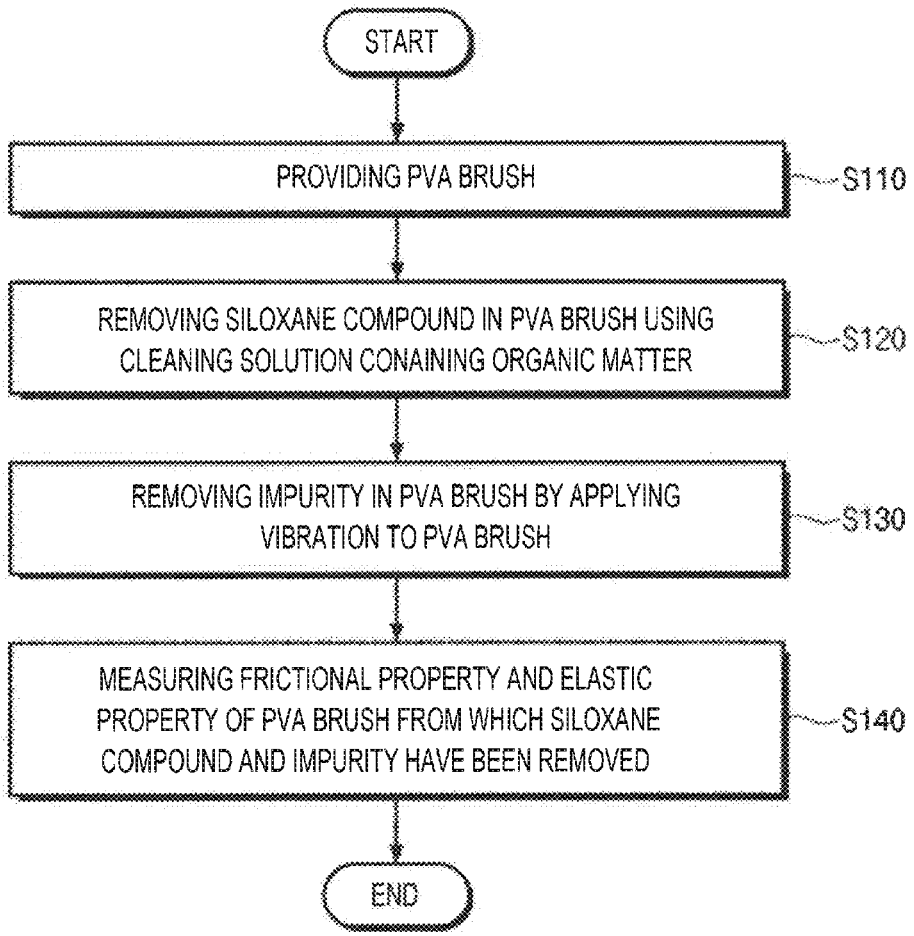
FIG. 1 is a flowchart illustrating a PVA brush cleaning method according to an embodiment of the present disclosure.

10: PVA brush cleaning apparatus
20, 21, 22: PVA brush, core, protrusion
23*a*, 23*h*: siloxane compound, impurities
25: cleaning solution
30: vibration device
31: vibration generator
32: oscillator
33, 34: frequency control device, power control device
50: cleaning solution supply device
51: nozzle
52: tank
53: pump
54: filter
55: pressure gauge
56: flow meter
57: pump control device
60*a*: particle measurement device
60*b*: organic matter measurement device
70: frictional property measurement device
80: elastic property measurement device
100: PVA brush
110*a*: siloxane compound
110*b*: impurities
200: cleaning solution
300: vibration device

DETAILED DESCRIPTION TO EXECUTE THE INVENTION

Hereinafter, embodiments of the present disclosure will be described in detail with reference to the accompanying drawings. However, the technical idea of the present disclosure is not limited to the embodiments described herein, and may be implemented in other forms. Rather, the embodiments disclosed herein are provided so as to make the present disclosure thorough and complete and to help a person ordinarily skilled in the art fully understand the concept of the present disclosure.

In this specification, when it is described that a component is present on another component, it means that the component may be directly formed on that another component or that a third component may be interposed therebetween. In addition, in the drawings, the thicknesses of films and regions are exaggerated for an effective explanation of technical contents.

While the terms such as first, second, and third are used in various embodiments of the present disclosure in order to describe various components, these components should not be limited by these terms. These terms are merely used to distinguish one component from other components. Accordingly, what is referred to as a first component in any one embodiment may be referred to as a second component in another embodiment. Each embodiment described and exemplified herein also includes an embodiment complementary thereto. In this specification, the term "and/or" is used to mean at least one of the components listed before and after the term.

Herein, a singular expression may include the meaning of a plural expression unless the context clearly define the meaning otherwise. It is to be understood that the terms such as "include" and "have" are intended to specify the presence of a feature, an integer, a step, a component disclosed in the specification, or a combination thereof, and should not be understood to preclude the possibility of presence or addition of one or more other features, figures, steps, components, or a combination thereof. Herein, the term "connect" is used in the meaning of including both indirectly connecting and directly connecting a plurality of components.

In the following description of the present disclosure, a detailed description of related known functions or configurations will be omitted when it is determined that the detailed description may make the subject matter of the present disclosure unclear.

A PVA brush is used for removing residues on a substrate, for example, in a chemical mechanical planarization (CMP) process, a semiconductor process, and a display process. Such a PVA brush may include impurities such as, for example, a pore-forming agent, a mold release agent, and PVA debris, therein due to a defect in the manufacturing process. These impurities may be transferred to a substrate while residues on the substrate are removed, thereby causing a problem of deteriorating the yield of products obtained in a chemical mechanical planarization process, a semiconductor process, and a display process. Hereinafter, a method of removing impurities in a PVA brush will be described with reference to FIGS. 1 and 2.

Figure 2:
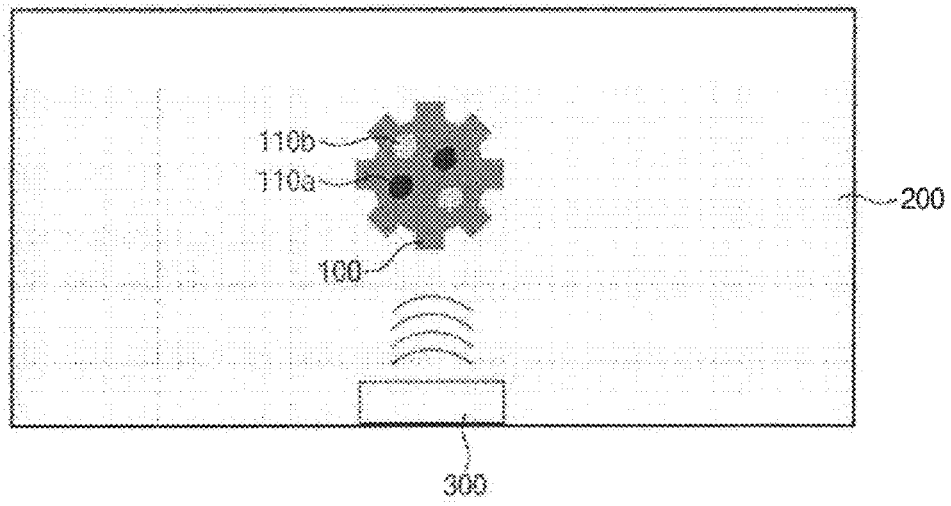
FIG. 2 is a view illustrating the PVA brush cleaning method according to the embodiment of the present disclosure.

FIG. 1 is a flowchart illustrating a PVA brush cleaning method according to an embodiment of the present disclosure, and FIG. 2 is a view illustrating the PVA brush cleaning method according to the embodiment of the present disclosure.

Referring to FIGS. 1 and 2, a PVA brush 100 is provided (S110). According to an embodiment, the PVA brush 100 may be in a state before being used. That is, the PVA brush 100 may be in a state before removing residues on a substrate, for example, in a chemical mechanical planarization (CMP) process, a semiconductor process, or a display process.

In the manufacturing process of the PVA brush 100, a siloxane compound may be used, and for example, the siloxane compound and impurities may remain in the manufactured PVA brush 100. Specifically, when the PVA brush 100 is manufactured by injection molding, a siloxane compound may be used in the manufacturing process, and the siloxane compound may remain on the surface of the PVA brush 100 and inside the PVA brush 100.

Hereinafter, a method of removing a siloxane compound and purities in the PVA brush 100 will be described in detail.

The siloxane compound 110*a* in the PVA brush 100 may be removed (S120). The siloxane compound 110*a* may be removed using a cleaning solution 200. According to an embodiment, the siloxane compound 110*a* may be removed by immersing the PVA brush 100 in a container filled with the cleaning solution 200. That is, when the cleaning solution 200 and the siloxane compound 110*a* react with each other, the siloxane compound 110*a* may be dissolved into the cleaning solution 200 and removed from the PVA brush 100.

According to an embodiment, the cleaning solution 200 may include organic matter. For example, the organic matter may be tetrahydrofuran (THF), or tetramethylammonium hydroxide (TMAH). According to an embodiment, the siloxane compound 110*a* may be polydimethylsiloxane (PDMS).

The amount of the siloxane compound 110*a* to be removed may increase as the concentration of the organic matter in the cleaning solution 200 increases. However, when the concentration of the organic matter in the cleaning solution 200 is higher than a predetermined range, the PVA brush 100 may be damaged. According to an embodiment, the cleaning solution 200 may include the organic matter at a concentration of 10 wt % or more and less than 50 wt %.

According to another embodiment, the cleaning solution 200 may include an organic solvent, a basic solution, and an acidic solution. For example, the organic solvent may include at least one of toluene, xylene, benzene, solvent naptha, kerosene, cyclohexane, n-hexane, n-heptane, diisopropyl ether, hexyl ether, ethyl acetate, butyl acetate, isopropyl laurate, isopropyl palmitate, tetrahydrofuran. It may include at least one of isopropyl myristate, dimethyl sulfoxide, methyl ethyl ketone, methyl isobutyl ketone, methyl isobutyhl ketone, and lauryl alcohol. For example, the basic solution may include at least one of KOH, NaOH, CeOH, RbOH, $NH_4OH$, tetramethylammonium hydroxide, tetraethylammonium hydroxide, tetrabutylammonium hydroxide, tetrapropylammonium hydroxide, ethylene diamine, pyrocatechol, and pyrazine. For example, the acidic solution may include at least one of HCl, $H_2SO_4$, HF, and $HNO_3$.

The impurities 110*a* in the PVA brush 100 may be removed (S130), The impurities may be removed by applying vibration to the PVA brush 100. For this purpose, the vibration device 300 may be provided in the container for removing the impurities 110*b* in the PVA brush 100. That is, when vibration generated by the vibration device 300 is applied to the PVA brush 100, the impurities 110*b* in the PVA brush 100 may be detached and removed from the PVA brush 100.

According to an embodiment, the impurities 110*b* may be, for example, a pore-forming agent and PVA debris having a low bonding strength due to incomplete cross-linking. For example, the pore-forming agent may be, for example, potato starch or corn starch. According to an embodiment, the vibration device 300 may be an ultrasonic generation device.

According to an exemplary embodiment, when the vibration is applied to the PVA brush 100 for a time of 10 minutes, the amount of the impurities 110*b* removed from the PVA brush 100 may have a maximum value. Accordingly, most of the impurities 110*b* in the PVA brush 100 may be removed within 10 minutes after applying the vibration to the PVA brush 100.

Further, according to an embodiment, when the frequency of the vibration applied to the PVA brush 100 is low, the amount of the impurities 110*b* in the PVA brush 100 may be smaller than that in the case where vibration is applied to the PVA brush 100 at a higher frequency. That is, when the impurities 110*b* are removed by applying vibration to the PVA brush 100, the removal efficiency of the impurities 110*b* in the PVA brush 100 may be higher in the case of applying the vibration having a low frequency than in the case of applying the vibration having a high frequency.

Referring to FIGS. 1 and 2, it has been described that when the siloxane compound 110*a* and the impurities 110*b* in the PVA brush 100 are removed, the siloxane compound 110*a* is first removed and then the impurities 110*b* are described. However, the siloxane compound 110*a* may be removed after the impurities 110*b* are removed. That is, the impurities 110*b* may be first removed by applying vibration to the PVA brush 100, and then the siloxane compound 110*a* may be removed by immersing the PVA brush 100 in the cleaning solution 200.

In addition, according to an embodiment, the siloxane compound 110*a* and the impurities 1106 in the PVA brush 100 may be simultaneously removed. That is, the siloxane compound 110*a* and the impurities 110*b* may be simultaneously removed by placing the vibration device 300 in the container 200 in which the cleaning solution 200 is contained, and applying vibration while the PVA brush 100 is immersed.

According to an embodiment, the PVA brush 100 from which the siloxane compound 110*a* and the impurities 110*b* have been removed may be rinsed. That is, the cleaning solution 200 remaining on the surface of the PVA brush 400 and inside the PVA brush 100 may be removed using a rinsing solution. For example, the rinsing solution may be ultra-pure water (DIW).

According to an embodiment, the method of cleaning the PVA brush 100 may further include a step of measuring a frictional property and an elastic property of the PVA brush 100 from which the siloxane compound 110*a* and the impurities 110*b* have been removed.

For example, the frictional property of the PVA brush 100 from which the siloxane compound 110*a* and the impurities 110*b* have been removed may be measured by measuring a change in rotational force of a rotary motor depending on a change in frictional property between the PVA brush 100 and a friction member.

For example, the elastic property of the PVA brush 100 from which the siloxane compound 110*a* and the impurities 110*b* have been removed may be measured by measuring a change in elastic force of an elastic property measurement device depending on a change in elastic property between the PVA brush 100 and the friction member.

The step of removing the siloxane compound 110*a* in the PVA brush 100 and the step of removing the impurities 110*b* in the PVA brush 100 may be defined as a unit process. The unit process may be repeated when the frictional property and the elastic property of the PVA brush 100 from which the siloxane compound 110*a* and the impurities 110*b* have been removed are below a reference range. The unit process may be repeatedly performed until the frictional property and the elastic property are in the reference range.

In other words, the siloxane compound 110*a* and the impurities 100*b* in the PVA brush 100 may be removed by performing the step of removing the siloxane compound 110*a* in the PVA brush 100 and the step of removing the impurities 110*b* in the PVA brush 100. When the frictional property and the elastic property of the PVA brush 100 from which the siloxane compound 110*a* and the impurity 110*b* have been removed and the measured frictional property and the elastic property are below the reference range, the step of removing the siloxane compound 100*a* in the PVA brush 100 and the step of removing the impurities 110*b* in the PVA brush 100 may be repeated until the frictional and elastic properties are in the reference range. Accordingly, it is easy to control the frictional property and the elastic property of the cleaned PVA brush 100.

Unlike the method of cleaning the PVA brush 100 according to the embodiment of the present disclosure described above, the PVA brush cleaning method that allows ultra-pure water (DEW) to pass through the inside of the PVA brush is not capable of removing organic matter such as silicon. In addition, the PVA brush cleaning method that allows the ultra-pure water to pass through the PVA brush has a problem in that it takes a long time in the pre-processing due to the low impurity removal efficiency thereby deteriorating the productivity (throughput) of CMP equipment, and in that impurities are transferred onto the substrate during a post-CMP cleaning process, thereby deteriorating yield.

Unlike this, the method of cleaning the PVA brush 100 according to an embodiment of the present disclosure may include steps of: providing the PVA brush 100, removing a siloxane compound 110*a* in the PVA brush 100 using the cleaning solution 200 containing the organic matter; and removing impurities in the PVA brush 100 by applying vibration to the PVA brush 100. Accordingly, for example, the organic matter such as silicon and impurities in the form of particles in the PVA brush 100 are easily removed. As a result, it is possible to provide a PVA brush cleaning method, which is capable of improving the yield of products obtained in, for example, a chemical mechanical planarization process, a semiconductor process, and a display, process.

Hereinafter, a PVA brush cleaning apparatus for removing the silicon compound 110*a* and the impurities 110*b* in the PVA brush 100 will be described with reference to FIGS. 3 to 5.

Figure 3:
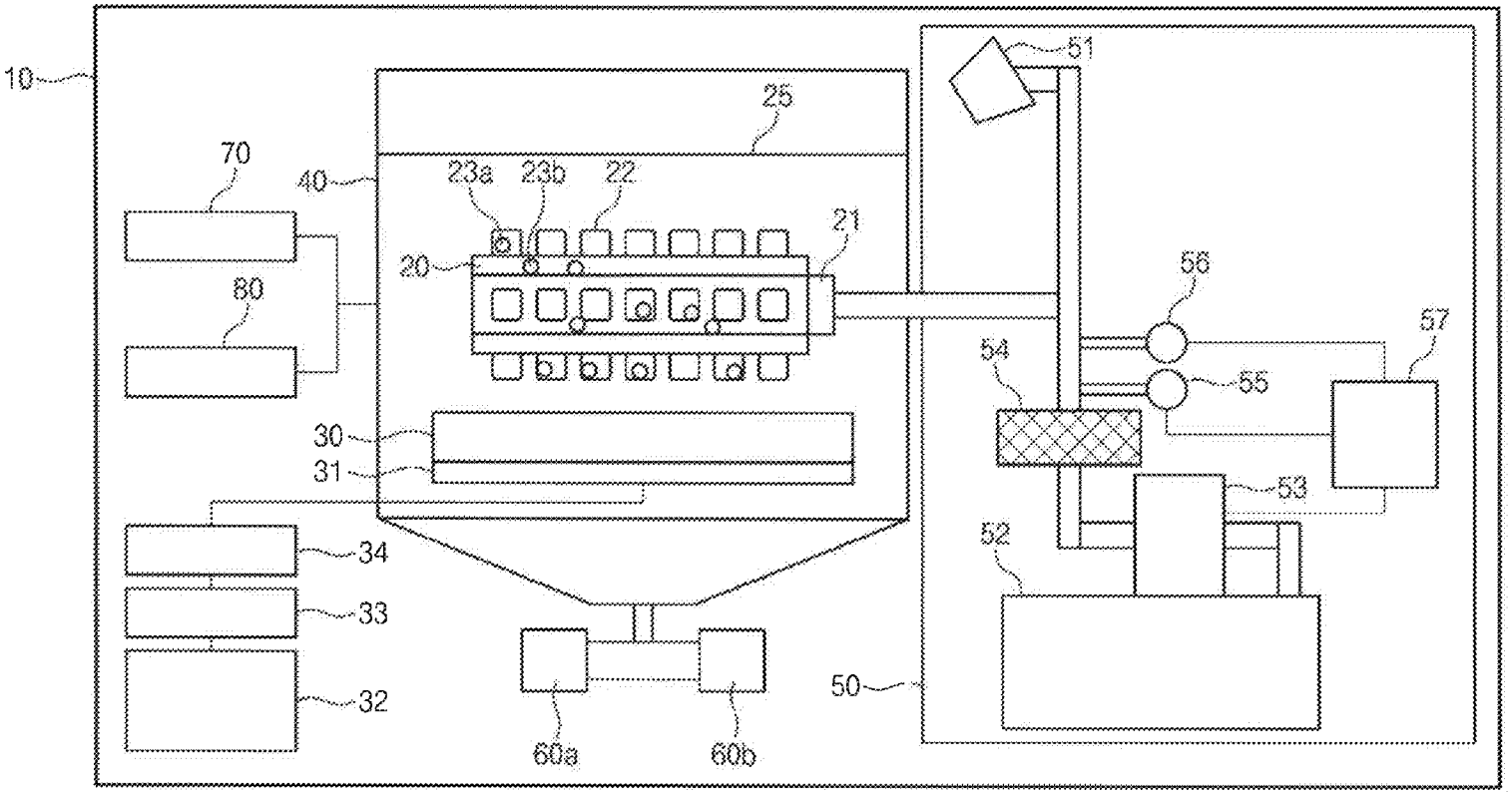
FIG. 3 is a view illustrating a PVA brush cleaning apparatus according to an embodiment of the present disclosure.
Figure 4:
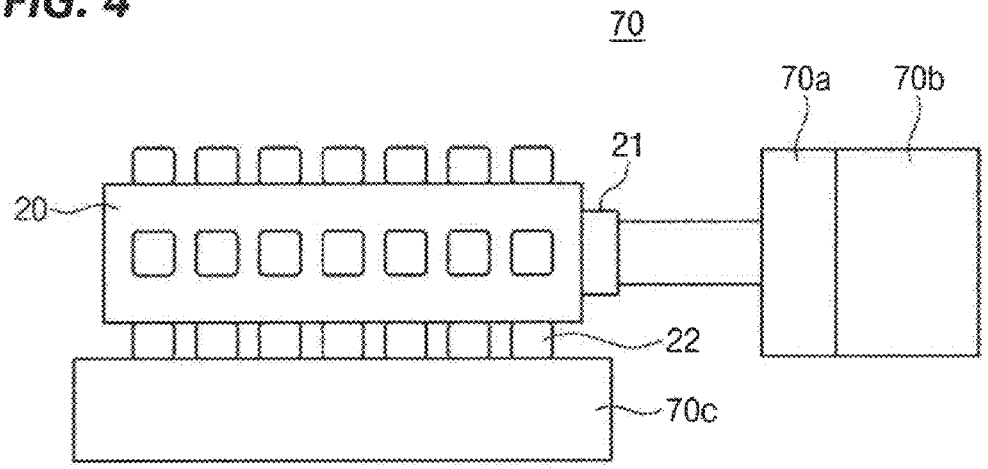
FIG. 4 is a flowchart illustrating a frictional property measurement device according to an embodiment of the present disclosure.
Figure 5:
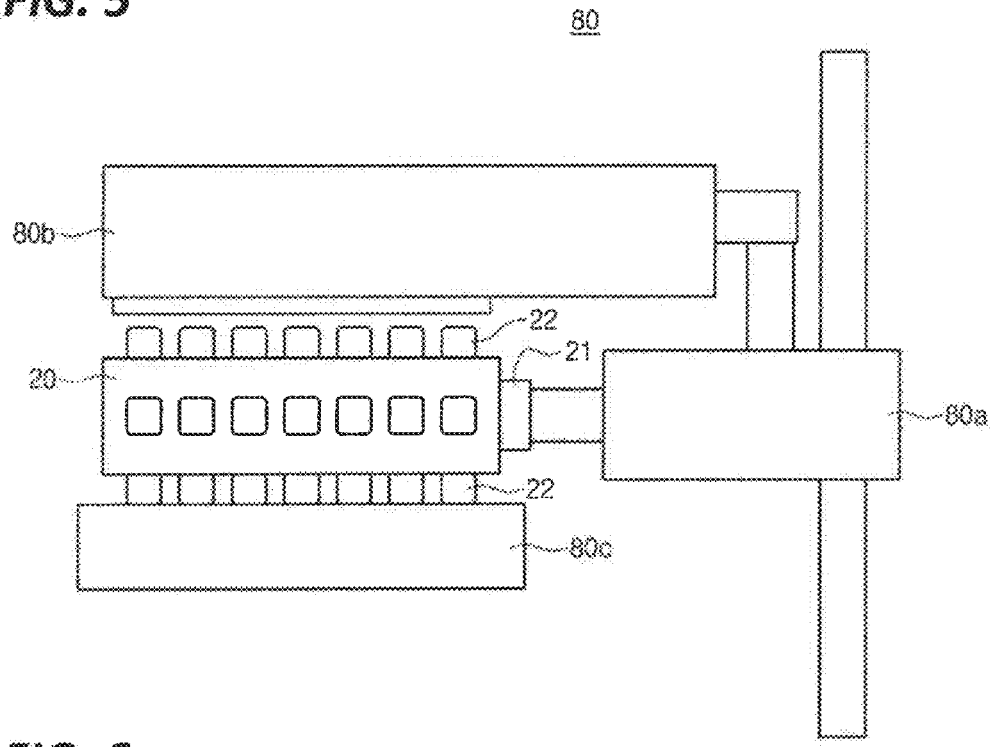
FIG. 5 is a flowchart illustrating an elastic property measurement device according to an embodiment of the present disclosure.

FIG. 3 is a view illustrating a PVA brush cleaning apparatus according to an embodiment of the present disclosure, FIG. 4 is a flowchart illustrating a frictional property measurement device according to an embodiment of the present disclosure, and FIG. 5 is a flowchart illustrating an elastic property measurement device according to an embodiment of the present disclosure.

Referring to FIG. 3, the PVA brush cleaning apparatus 10 according to an embodiment of the present invention may include a cleaning container 40, a cleaning solution supply device 50, a particle measurement device 60*a*, and an organic matter measurement device 60*b*, a frictional property measurement device 70, and an elastic property measurement device 80.

In the cleaning container 40, a PVA brush 20, a cleaning solution 25, a vibration device 30, and a vibration generator 31 may be disposed.

The PVA brush 20 and the cleaning solution 25 may be the same as the PVA brush and the cleaning solution described in the PVA brush cleaning method described with reference to FIGS. 1 and 2. According to an embodiment, the PVA brush may include a core 21 and protrusions 22.

The PVA brush 20 may include, for example, a siloxane compound 23*a* and impurities 23*b* due to a defect in the manufacturing process thereof. The siloxane compound 23*a* in the PVA brush 20 may be removed using the cleaning solution 25 including organic matter. According to an embodiment, the siloxane compound 23*a* in the PVA brush 20 may be removed by immersing the PVA brush 20 in the cleaning solution 25.

The amount of the siloxane compound 23*a* to be removed may increase as the concentration of the organic matter in the cleaning solution 25 increases. However, when the concentration of the organic matter in the cleaning solution 25 is higher than a predetermined range, the PVA brush 20 may be damaged. According to an embodiment, the cleaning solution 25 may include the organic matter at a concentration of 10 wt % or more and less than 50 wt %. According to an embodiment, the organic matter may be THF or TMAH. According to an embodiment, the siloxane compound may be PDMS.

The impurities 23*b* in the brush 20 may be removed by providing vibration to the brush 20, For this purpose, the vibration generator 31 may generate vibration, and the vibration device 30 may provide the generated vibration to the brush 20. The impurities 23*b* and the vibration may be the same as the impurities and the vibration described in the PVA brush cleaning method described with reference to FIGS. 1 and 2.

According to an embodiment, when the vibration device 30 provides the vibration to the PVA brush 20 for a time of 10 minutes, the amount of the impurities 23*b* removed from the PVA brush 20 may have a maximum value. Accordingly, most of the impurities 23*b* in the PVA brush 20 may be removed within 10 minutes after applying the vibration to the PVA brush 20.

According to an embodiment, the vibration generator 31 may be connected to an oscillator 32 configured to oscillate the vibration generator 31, a frequency control device 33, and a power control device 34, According to an embodiment, the vibration device 30 may include at least one of quartz, alumina, ceramic, and metal.

The cleaning solution supply device 50 may include a nozzle 51, a tank 5 pump 53, a filter 54, a pressure gauge 55, a flow meter 56, and a pump control device 57.

Specifically, the cleaning solution supply device 50 may supply the cleaning solution 25 directly to the core 21 on the PVA brush 20 through the nozzle 51 or may supply the cleaning solution 50 to the cleaning container 40. The tank 52 may store the cleaning solution 25. The pump may regulate the pressure between the tank 52 and the cleaning container 40. For example, the pump 53 may be, for example, a diaphragm pump, a bellows metering pump, a peristaltic pump, a syringe pump, a solenoid diaphragm pump, a magnet drive impeller pump, or a magnetically levitated centrifugal pump.

The filter 54 may remove impurities in the cleaning solution 25 provided from the pump 53 into the cleaning container 40. According to an embodiment, the filter 54 may have pores having a size from 10 nm to 200 nm. According to an embodiment, the filter 54 may include a valve (not illustrated). For example, the valve may be a vent valve or a discharge valve. According to an embodiment, the filter 54 may include at least one of polyethersulfone (PES), polytetrafluorethylene (PTFE), surfactant-free cellulose acetate (SFCA), polyvinylidene fluoride (PVDF), cellulose, nylon, cellulose acetate, cellulose nitrate, glass microfiber, and polypropylene.

The pressure gauge 55 may check the supply pressure of the cleaning solution 25. The pressure gauge 56 may check the supply flow rate of the cleaning solution 25. The pump control device 57 may regulate the supply flow rate condition and the supply, flow rate condition of the cleaning solution 25.

The particle measurement device 60*a* may measure the size and number of the impurities 23*b* in the cleaned PVA brush 20. For example, the particle measurement device 60*a* may measure a residual pore-forming agent in the cleaned PVA brush 20 and PVA debris having a low bonding strength due to, for example, incomplete cross-linking. For example, the particle measurement device 60*a* may be, for example, an extinction detector, a single particle optical sizing (SPOS) device, a laser diffraction device, a dynamic light scattering device, or an acoustic attenuation spectroscopy device.

The organic matter measurement device 60*b* may measure the amount of the siloxane compound 23*a* in the cleaned PVA brush 20. For example, the organic matter measurement device 60*b* may measure the amount of PDMS in the cleaned PVA brush 20. For example, the organic matter measurement device 60*h* may be, for example, an ultraviolet detector, a conductivity detector, a current charge detector, a nondispersive infrared (NDIR) detector, or a total organic carbon analyzer.

The PVA brush 100 from which the siloxane compound 23*a* and the impurities 23*h* have been removed may be moved to the frictional property measurement device 70 and the elastic property measurement device 80, so that the frictional property and the elastic property of the PVA brush 100 may be measured. Hereinafter, the frictional property measurement device 70 and the elastic property measurement device 80 will be described in detail with reference to FIGS. 4 and 5. The frictional property measurement device 70 will be described first, and then the elastic property measurement device 80 will be described. However, the order of the frictional property measurement and the elastic property measurement of the PVA brush 20 is not limited thereto.

Referring to FIG. 4, the frictional property measurement device 70 may include a rotary motor 70*a*, a friction measurement device 70*b*, and a first friction member 70*c*. In the PVA brush 20, one end of the core 21 may be connected to the rotary motor 70*a*, and one ends of the protrusions 22 may come into contact with the first friction member 70*c*. Accordingly; the frictional property of the PVA brush 20 may be measured by measuring a change in frictional property between the PVA brush 20 and the first friction member 70*c* and a change in rotational force of the rotary motor 70*a*.

For example, the friction measurement device 70*b* may be at least one of a surface acoustic wave (SAW) torque sensor, an embedded magnetic domain (EMD) torque sensor, an optical electronic torque sensor, a telemetry torque sensor, a wire torque sensor, a stationary torque sensor, a slip ring rotational torque sensor, and a contactless rotational torque sensor.

Referring to FIG. 5, the frictional property measurement device 80 may include a movement motor 80*a*, an elasticity measurement device 80*b*, and a second friction member 80*c*. In the PVA brush 20, one end of the core 21 may be connected to the rotary motor 80*a*, and one ends of the protrusions 22 may come into contact with the second friction member 80*c*. In addition, the other ends of the protrusions 22 disposed on the opposite side of the protrusions 22, which come into contact with the second friction member 80*c*, may come into contact with the elasticity measurement device 80. Accordingly, the elastic property of the PVA brush 20 may be measured by measuring a change in elastic property between the PVA brush 20 and the second friction member 80*c* and a change in pressure of the elasticity measurement device 80*b*.

For example, the elasticity measurement device 80*b* may be at least one of a strain gauge load cell, a beam load cell, and a column load cell.

According to an embodiment, the PVA brush cleaning apparatus 10 may include: a cleaning container 40 in which a cleaning solution 25 containing organic matter for removing a siloxane compound 23*a* in a PVA brush 20 is disposed; a vibration device 30 configured to provide vibration for removing impurities 23*b* in the PVA brush 20 to the PVA brush 20 and disposed in the cleaning container 40; a frictional property measurement device 70 configured to measure a frictional property of the PVA brush 20 from which the siloxane 23*a* and the impurities 23*b* have been removed; and an elasticity measurement device 80 configured to measure an elastic property of the PVA brush 20 from which the siloxane compound 23*a* and the impurities 23*b* have been removed. Accordingly, for example, the organic matter such as silicon and impurities in the form of particles in the PVA brush 20 are easily removed. As a result, it is possible to provide a PVA brush cleaning apparatus, which is improved in the yield of products obtained in, for example, a chemical mechanical planarization process, a semiconductor process, and a display process.

Hereinafter, specific test examples and characteristic evaluations of the INA brush cleaning method according to the above embodiment will be described.

Figure 6:
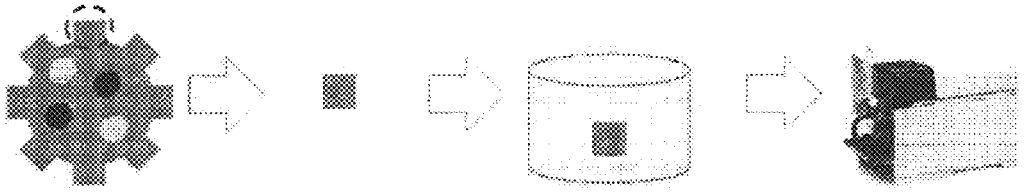
FIG. 6 illustrates a view of a method of measuring a characteristic of a PVA brush before the PVA brush cleaning method according to the embodiment of the present disclosure is performed, and a photograph of a measurement device therefor.

FIG. 6 illustrates a view of a method of measuring a characteristic of a PVA brush before the PVA brush cleaning method according to the embodiment of the present disclosure is performed, and a photograph of a measurement device therefor.

TABLE 1

| Element | Concentration (ug/g) | SD (Standard Devation) | Relative SD (%) | Composition (%) | Total Amount (ug/g) |
|---|---|---|---|---|---|
| Si | 4278.596 | 157.878 | 3.690 | 88.650 | 4,826 |
| Ti | 523.721 | 25.080 | 4.789 | 10.851 | |
| W | 0.036 | 0.002 | 4.162 | 0.001 | |
| Cu | 14.118 | 0.672 | 4.764 | 0.293 | |
| Fe | 9.916 | 0.751 | 7.575 | 0.205 | |

As can be seen from FIG. 6 and Table 1, the PVA brushes subjected to the microwave ashing in the $H_3PO_4$ solution contain, for example, about 88.65 wt % of Si and about 10.85 wt % of Ti. That is, it can be seen that a large amount of siloxane and impurities were contained in the PVA brushes before the PVA brush cleaning method according to the embodiment was performed.

Figure 7:
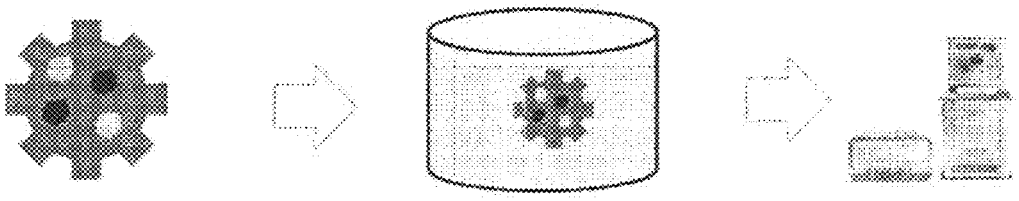
FIG. 7 illustrates a view of a method of measuring a characteristic of a PVA brush cleaned by the PVA brush cleaning method according to the embodiment of the present disclosure and a photograph of a measurement device therefor.
Figure 8:
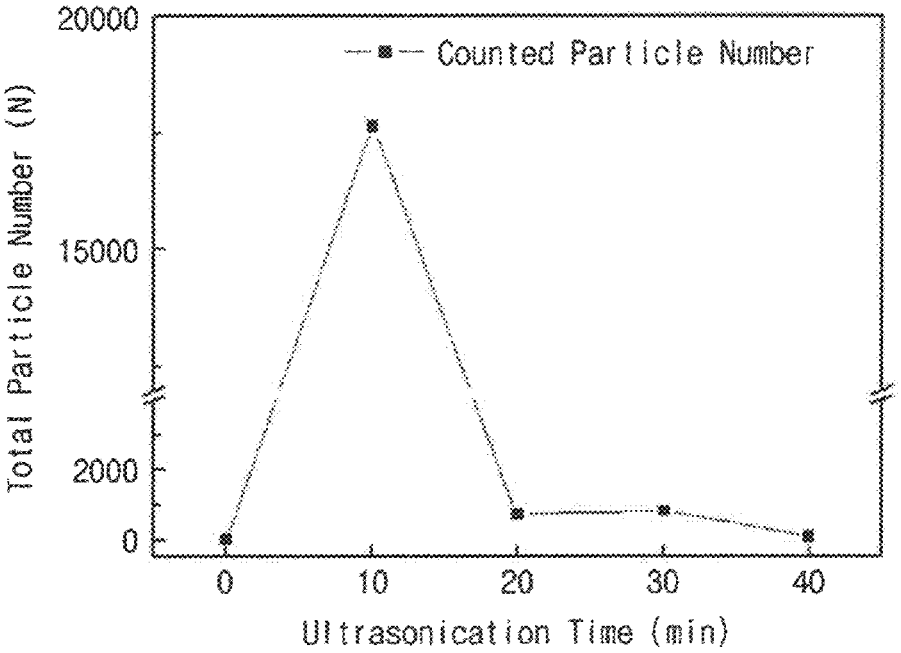
FIG. 8 is a graph representing the amount of impurities removed depending on a vibration time in the PVA brush cleaning method according to the embodiment of the present disclosure.

FIG. 7 illustrates a view of a method of measuring a characteristic of a PVA brush cleaned by the PVA brush cleaning method according to the embodiment of the present disclosure, and a photograph of a measurement device therefor, and FIG. 8 is a graph representing the amount of impurities removed depending on a vibration time in the PVA brush cleaning method according to the embodiment of the present disclosure.

Referring to FIG. 7, a PVA brush was immersed in a solution obtained by mixing 20 wt % of THF and 80 wt % of DIW, the impurities in the PVA brush was removed using ultrasonic waves having a frequency of 40 kHz and a power of 600 W, and the amount of removed impurities was measured, Accusizer 780AD from PSS Co. Ltd. (USA) was used for measuring the removed impurities.

Referring to FIG. 8, after cleaning the PVA brush by providing ultrasonic waves far a time of 0 to 40 minutes by the method described above with reference to FIG. 7, the amount of impurities removed from the PVA brush was measured. As can be seen from FIG. 8, when the ultrasonic waves were provided to the PVA brush for a time of 10 minutes, it was confirmed that the amount of impurities removed from the PVA brush is significantly higher. That is, when performing the PVA brush cleaning method according to the embodiment, it can be seen that most impurities were removed for a time within 10 minutes for which ultrasonic waves were provided. When the ultrasonic are were provided to the PVA brush, it is possible to collect impurities at a high concentration. Thus, it is easy to analyze impurities in the PVA brush.

Figure 9:
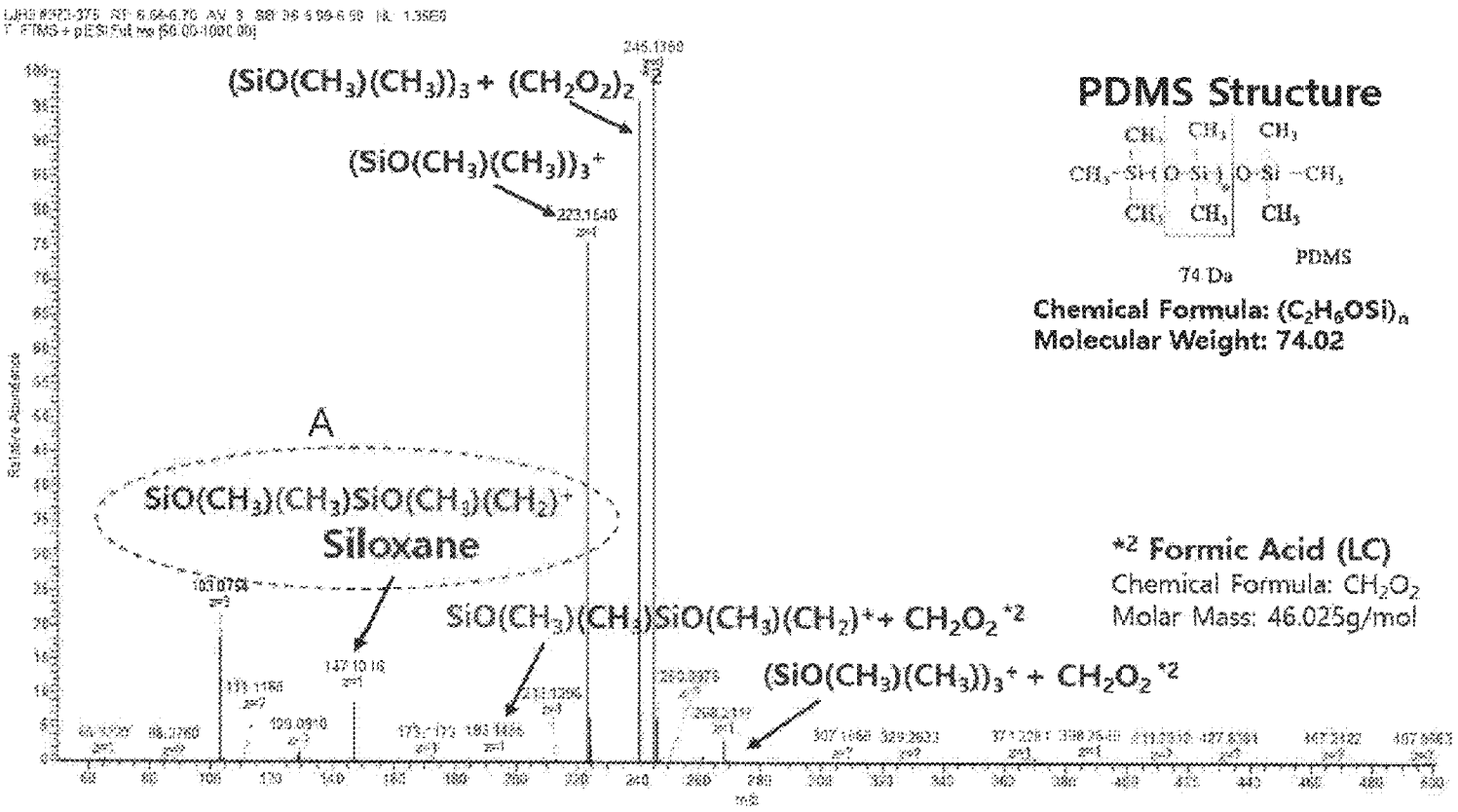
FIG. 9 is a graph representing the results of LC-MS measurement of materials removed by the PVA brush cleaning method according to the embodiment of the present disclosure.

FIG. 9 is a graph representing the results of LC-MS measurement of materials removed by the PVA brush cleaning method according to the embodiment of the present disclosure.

Referring to FIG. 9, the materials removed by the method described above in FIG. 7 were measured using liquid chromatography-mass spectrometry (LC-MS). As can be seen from portion A of FIG. 9, the PVA brush cleaning method according to the embodiment described above was performed and it was confirmed that PDMS was contained in the materials removed from the PVA brush.

Figure 10:
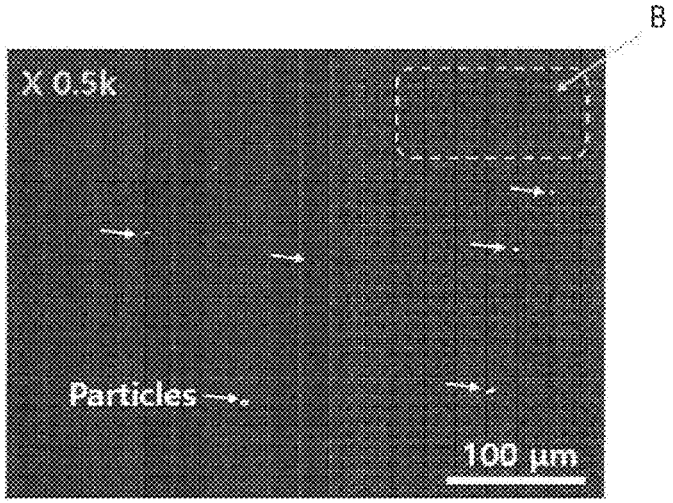
FIGS. 10 and 11 are electron microscope photographs obtained by capturing materials removed by the PVA brush cleaning method according to the embodiment of the present disclosure.
Figure 11:
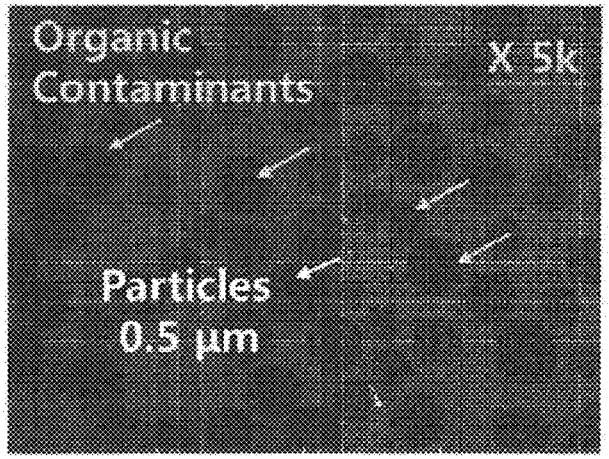

FIGS. 10 and 11 are electron microscope photographs obtained by capturing the materials removed by the PVA brush cleaning method according to the embodiment of the present disclosure.

Referring to FIG. 10, after drying the materials removed by the method described above with reference to FIG. 7, the materials were photographed at a magnification of 0.5 k using a field emission-scanning electron microscope (FE-SEM). As can be seen from FIG. 10, it was confirmed that the impurity particles are distributed throughout the materials removed by the method according to the embodiment described above.

Referring to FIG. 11, the portion B of FIG. 10 was captured in an enlarged scale at a magnification of 5 k using an FE-SEM. As can be seen from FIG. 11, it was confirmed that the impurity particles as well as PDMS (organic containments) are distributed throughout the materials removed by the method according to the embodiment described above.

Figure 12:
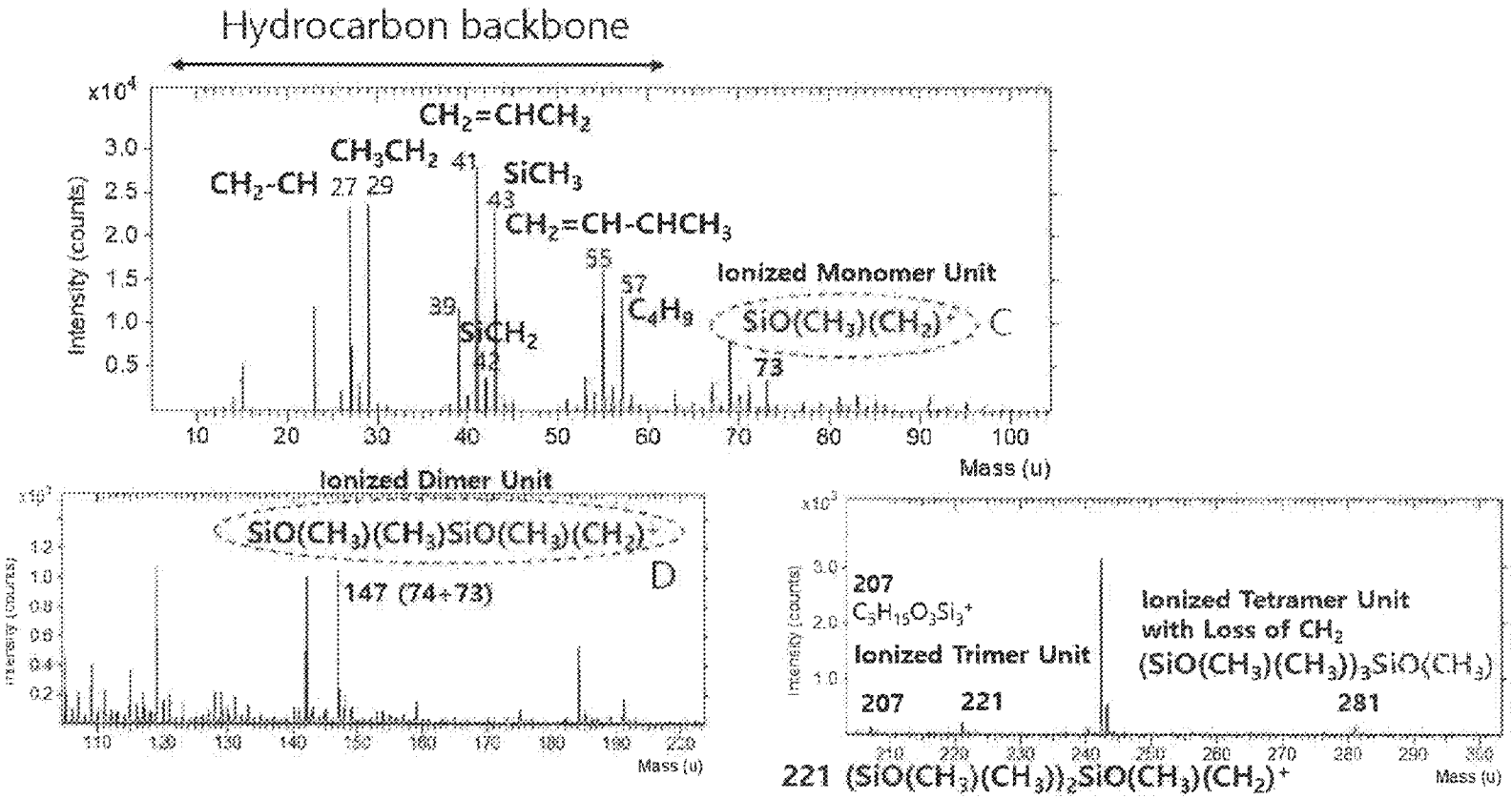
FIG. 12 illustrates graphs representing the results of TOF-SIMS measurement of materials removed by a PVA brush cleaning method according to an embodiment of the present disclosure.

FIG. 12 illustrates graphs representing the results of TOF-SIMS measurement of materials removed by a PVA brush cleaning method according to an embodiment of the present disclosure.

Referring to FIG. 12, after drying the materials removed by the method described above in FIG. 7, liquid chromatography-mass spectrometry (LC-MS) measurement was performed. From portions C and D of FIG. 12, it can be seen that the materials removed by the method according to the embodiment described above include siloxane.

As can be seen from FIGS. 8 to 12, it can be seen that, when a PVA brush was cleaned using the PVA brush cleaning method according to an embodiment of the present disclosure, PDMS and impurities are easily removed from the PVA brush.

FIGS. 13A and 13B and FIGS. 14A and 14B are photographs comparing the efficiencies of cleaning solutions in the PVA brush cleaning method according to the embodiment of the present disclosure.

Figure 13A:
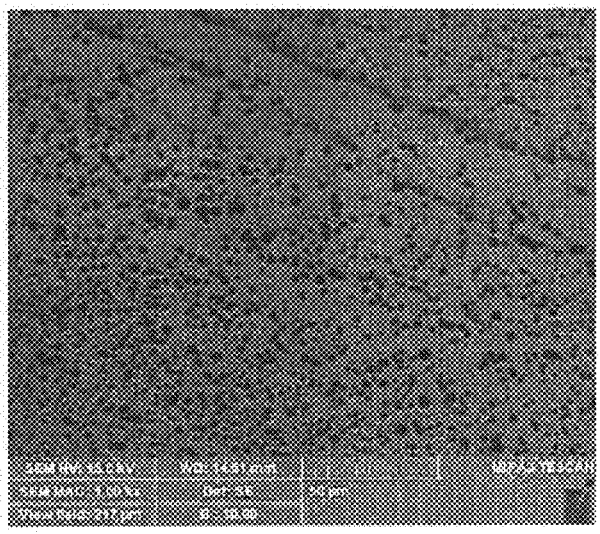
FIGS. 13A and 13B and FIGS. 14A and 14B are photographs comparing the efficiencies of cleaning solutions in the PVA brush cleaning method according to the embodiment of the present disclosure.
Figure 13B:
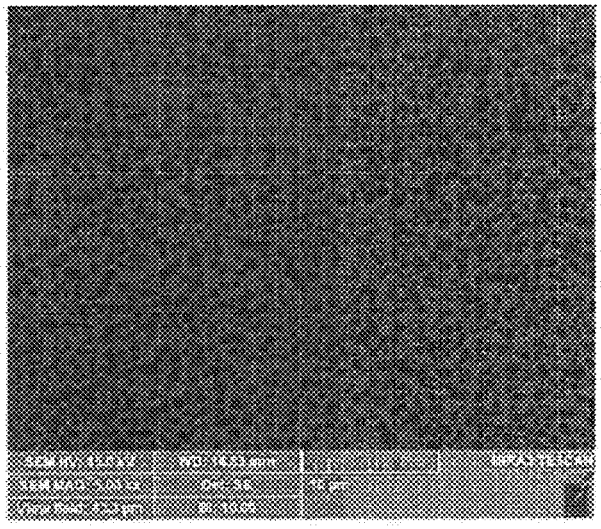

Referring to FIGS. 13A and 13B, a PVA brush was cleaned by the method described above with reference to FIG. 7 but using a cleaning solution containing only DIW without THF, and the surface of the cleaned PVA brush was photographed at magnifications of 1 k and 5 k using an FE-SEM. As can be seen from FIGS. 13A and 13B, when the PVA brush was cleaned using the cleaning solution containing only DIW water without THF, it was confirmed that a large amount of PDMS remained on the surface of the PVA brush.

Figure 14A:
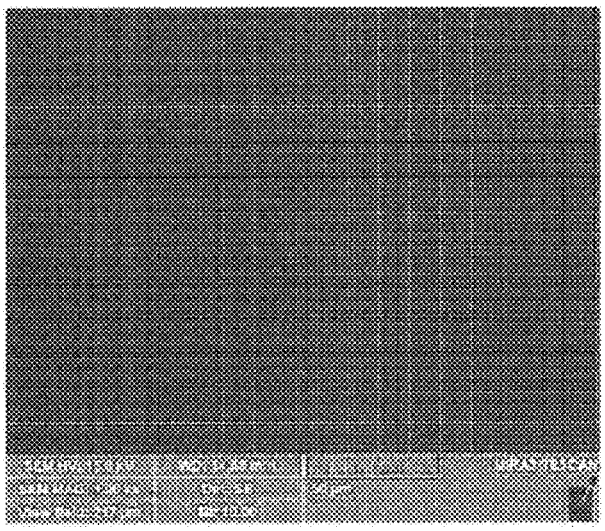
Figure 14B:
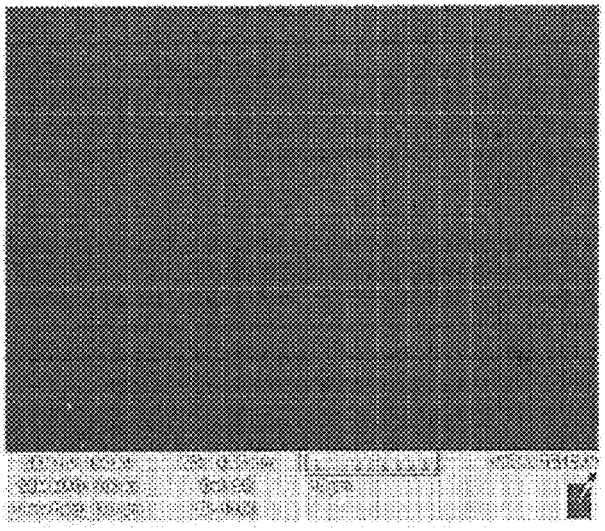

Referring to FIGS. 14A and 14B, a PVA brush was cleaned by the method described above with reference to FIG. 7, and the surface of the cleaned PVA brush was photographed at magnifications of 1 k and 5 k using an FE-SEM. As can be seen from FIGS. 14A and 14B, when the PVA brush was cleaned by the PVA brush cleaning method according to the embodiment described above, it was confirmed that there was substantially no PDMS left on the surface of the PVA brush.

That is, from FIGS. 13A, 13B, 14A, and 14B, it can be seen that when cleaning the PVA brush, PDMS is easily removed by THE However, as the concentration of THF increases, the PVA brush may be damaged. Thus, it is necessary to adjust the concentration of THF. Test results for determining the concentration of THF that is capable of removing PDMS without damaging the PVA brush are summarized in Tables 2 to 4 below.

TABLE 2

| THF Concentration (wt %) | Removal Rate (wt %) |
|---|---|
| 0 (DIW) | 0.555 |
| 10 | 21.0145 |
| 20 | 30.3738 |
| 30 | 46.3964 |
| 40 | 67.9012 |
| 50 | 77.7778 |
| 100 | 100 |

(Removal Rate=(Weight of removed PDMS/total weight of PDMS)*100%)

TABLE 3

| | Type | $\delta_D$(Mpa$^{1/2}$) | $\delta_P$(Mpa$^{1/2}$) | $\delta_H$(Mpa$^{1/2}$) | $R_0$ |
|---|---|---|---|---|---|
| Solute | PV Acetal | 21.3 | 13.3 | 17.4 | 13.3 |
| Solvent | THF(S1) | 16.8 | 5.7 | 8 | |
| | Water(S2) | 15.6 | 16 | 42.3 | |

($\delta_D$: dispersion force, $\delta_P$: polar force, $\delta_H$: hydrogen-bonding force, $R_0$: radius of solubility sphere)

TABLE 4

| % S1 | % S2 | $\delta_D$(Mpa$^{1/2}$) | $\delta_P$(Mpa$^{1/2}$) | $\delta_H$(Mpa$^{1/2}$) | RED (PVA) | PVA damage |
|---|---|---|---|---|---|---|
| 100 | 0 | 16.8 | 5.7 | 8 | 1.13 | O |
| 90 | 10 | 16.68 | 6.73 | 11.43 | 0.96 | O |
| 80 | 20 | 16.56 | 7.76 | 14.86 | 0.85 | O |
| 70 | 30 | 16.44 | 8.79 | 18.29 | 0.81 | O |
| 60 | 40 | 16.32 | 9.82 | 21.72 | 0.86 | O |
| 50 | 50 | 16.2 | 10.85 | 25.15 | 0.98 | O |
| 40 | 60 | 16.08 | 11.88 | 28.58 | 1.16 | X |
| 30 | 70 | 15.96 | 12.91 | 32.01 | 1.36 | X |
| 20 | 80 | 15.84 | 13.94 | 35.44 | 1.59 | X |
| 10 | 90 | 15.72 | 14.97 | 38.87 | 1.82 | X |
| 0 | 100 | 15.6 | 16 | 42.3 | 2.07 | X |

($\delta_D$: dispersion force, $\delta_P$: polar force, $\delta_H$: hydrogen-bonding force, $R_0$: radius of solubility sphere, RED: relative energy difference)

RED in Table 4 was calculated using Equations 1 and 2 below.

$$R_A^2=4(\delta_{D1}-\delta_{D2})^2+(\delta_{P1}-\delta_{P2})^2+(\delta_{H1}-\delta_{H2})^2 \quad \text{(Equation 1)}$$

($R_A$: Distance between molecules, 1: solvent, 2: solute)

$$\text{RED}=R_A/R_0 \quad \text{(Equation 2)}$$

($R_A$: Distance between molecules, $R_0$: radius of solubility sphere)

As can be seen from Tables 2 to 4 above, as the concentration of THF is increased, the removal rate of PDMS is improved, but when the concentration of THF is 50% or more, the PVA brush is damaged. In addition, it can be seen that when the value of RED in Table 4 described above is less than 1, the PVA brush is damaged. Accordingly, it can be seen that, in the cleaning solution used in the PVA brush cleaning method according to the embodiment described above, the effective concentration range of THF in which PDMS is capable of being removed without damaging the PVA brush is 10 wt % or more and less than 50 wt %.

Figure 15:
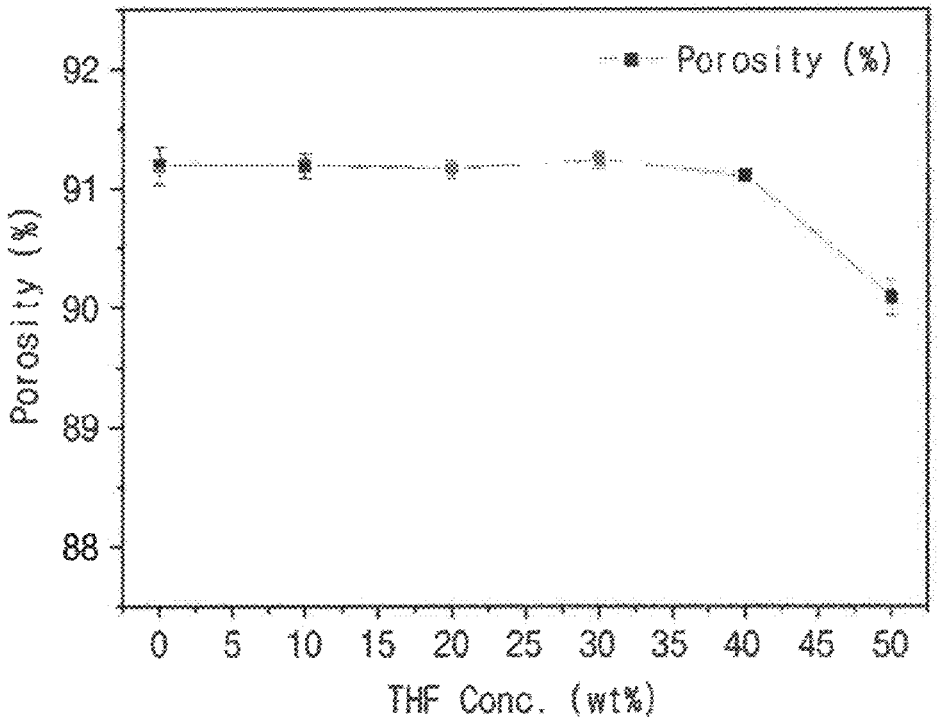
FIG. 15 is a view illustrating a characteristic of a PVA brush cleaned by the PVA brush cleaning method according to the embodiment of the present disclosure.

FIG. 15 is a view illustrating a characteristic of a PVA brush cleaned by the PVA brush cleaning method according to the embodiment of the present disclosure.

Referring to FIG. 15, a PVA brush was cleaned by the method described above with reference to FIG. 7 while changing the concentration of THF contained in the cleaning solution in the range of 0 wt % to 50 wt %, and porosity (%) was measured depending on the concentration of THF.

As can be seen in FIG. 15, it was confirmed that, in the PVA brush cleaned by the PVA brush cleaning method according to the embodiment described above, the porosity (%) gradually decrease when the concentration of THF contained in the cleaning solution exceeds 40%. The porosity (%) of the cleaned PVA brush was calculated using Equation 3 below.

$$\text{Porosity } (\%) = W_B - W_A / (W_B - W_A) - (W_A / D_{pva}) \quad \text{(Equation 3)}$$

($W_A$: weight of dried brush, $W_B$: weight of brush wet with water, $D_{PVA}$: density of PVA brush (1.3 g/cm$^3$)

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A PVA brush cleaning method comprising:

immersing a PVA brush in a cleaning solution containing an organic matter, thereby removing a siloxane compound in the PVA brush; and applying vibration to the PVA brush, thereby removing impurities in the PVA brush;

measuring a frictional property and an elastic property of the PVA brush from which the siloxane compound and the impurities have been removed, wherein the immersing and the applying are defined as a unit process, and the unit process is repeatedly performed when the frictional property and the elastic property of the PVA brush measured in the measuring are each below a respective reference range.

2. The PVA brush cleaning method according to claim 1, wherein the cleaning solution includes the organic matter at a concentration of 10 wt % or more and less than 50 wt %.

3. The PVA brush cleaning method according to claim 1, wherein, when the vibration is applied to the PVA brush for 10 minutes in the applying, an amount of the impurities removed from the PVA brush has a maximum value.

4. The PVA brush cleaning method according to claim 1, wherein the siloxane compound and the impurities in the PVA brush are simultaneously removed.

5. The PVA brush cleaning method according to claim 1, wherein the organic matter is tetrahydrofuran (THF) or tetramethylammonium hydroxide (TMAH).

6. The PVA brush cleaning method according to claim 1, wherein the siloxane compound is polydimethylsiloxane (PDMS).

7. The PVA brush cleaning method according to claim 1, wherein the applying includes measuring an amount of particulate impurities in the PVA brush to which the vibration is applied, using a particle measurement device.

8. The PVA brush cleaning method according to claim 7, wherein the particle measurement device is configured to perform at least one of a single particle optical sizing (SPOS) method, a laser diffraction method, a dynamic light scattering method, and an acoustic attenuation spectroscopy method.

9. The PVA brush cleaning method according to claim 1, wherein the applying includes measuring an amount of organic impurities in the PVA brush to which the vibration is applied, using an organic matter measurement device.

10. The PVA brush cleaning method according to claim 9, wherein the organic matter measurement device includes at least one of an ultraviolet detector, a conductivity detector, a current charge detector, a nondispersive infrared (NDIR) detector, and a total organic carbon analyzer.

11. The PVA brush cleaning method according to claim 1, wherein the cleaning solution includes the organic matter having a relative energy difference (RED) range of less than 1 with respect to the PVA brush.

* * * * *